US005863684A

United States Patent [19]

Suzuki et al.

[11] Patent Number: 5,863,684

[45] Date of Patent: Jan. 26, 1999

[54] DEVELOPER, IMAGE FORMING METHOD, AND MULTICOLOR IMAGE FORMING METHOD

[75] Inventors: Chiaki Suzuki; Hiroshi Nakazawa; Yoshifumi Iida, all of Minami-ashigara, Japan

[73] Assignee: Fuji Xerox Co., Ltd., Tokyo, Japan

[21] Appl. No.: 867,462

[22] Filed: Jun. 2, 1997

[30] Foreign Application Priority Data

Jun. 7, 1996 [JP] Japan ..... 8-146259
Jun. 17, 1996 [JP] Japan ..... 8-155432

[51] Int. Cl.[6] ..... G03G 13/01; G03G 9/097

[52] U.S. Cl. ..... 430/45; 430/110; 430/111

[58] Field of Search ..... 430/45, 110, 111

[56] References Cited

U.S. PATENT DOCUMENTS

| | | | |
|---|---|---|---|
| 5,604,071 | 2/1997 | Okado et al. | 430/110 |
| 5,635,326 | 6/1997 | Kanbayashi et al. | 430/110 |
| 5,637,432 | 6/1997 | Okado et al. | 430/111 |
| 5,665,512 | 9/1997 | Imai et al. | 430/111 |

FOREIGN PATENT DOCUMENTS

| | | |
|---|---|---|
| A-46-5782 | 12/1971 | Japan . |
| A-48-47345 | 7/1973 | Japan . |
| A-48-47346 | 7/1973 | Japan . |
| A-56-125751 | 10/1981 | Japan . |
| A-58-216252 | 12/1983 | Japan . |
| A-60-123862 | 7/1985 | Japan . |
| A-60-136755 | 7/1985 | Japan . |
| A-60-238847 | 11/1985 | Japan . |
| A-62-267766 | 11/1987 | Japan . |
| A-64-73354 | 3/1989 | Japan . |
| A-1-237561 | 9/1989 | Japan . |
| A-4-40471 | 2/1992 | Japan . |
| A-5-72797 | 3/1993 | Japan . |
| A-5-188633 | 7/1993 | Japan . |
| A-5-204183 | 8/1993 | Japan . |
| B-7-120086 | 12/1995 | Japan . |
| A-8-6286 | 1/1996 | Japan . |

OTHER PUBLICATIONS chemical Engineering Articles, vol. 18, pp. 303–307, (1992).

*Primary Examiner*—Roland Martin
*Attorney, Agent, or Firm*—Oliff & Berridge, PLC

[57] ABSTRACT

Disclosed is a developer comprising a carrier including, on a core, a resin coating layer in which an electroconductive material is dispersed in a matrix resin and a toner composition including toner particles containing a binder resin and a colorant, and, as an external additive, a titanium compound produced by a reaction of $TiO(OH)_2$ with a silane compound. Also disclosed is an image forming method using the developer. According to the invention, the charge property can be improved and fluctuation in the charge property caused by environmental change can be avoided.

15 Claims, 1 Drawing Sheet

DEVELOPER, IMAGE FORMING METHOD, AND MULTICOLOR IMAGE FORMING METHOD

BACKGROUND OF THE INVENTION

1. Field of the Invention

This invention relates to a developer used for developing electrostatic latent images, an image forming method, and a multicolor image forming method in an electrophotographic process or an electrostatic recording process.

2. Description of the Related Art

In an electrophotographic process, electrostatic latent images formed on a photoreceptor are developed using a toner containing a colorant, the developed toner images are transferred to transfer sheets, and the toner images are fixed using a heat roller, to prepare images. On the other hand, the photoreceptor is cleaned to remove toner remaining on the photoreceptor to prepare for forming the next image. Dry developers used for such an electrophotographic process are roughly classified into one-component developers using only a toner produced by dispersing a colorant in a binder resin and two-component developers produced by mixing the toner with a carrier.

Incidentally, in recent as advances in compact, high-speed, long-lived copy machines, high-speed photoreceptor and a developer carrying substrate having a smaller diameter have been needed, due to the cause of increasing stress to the developer. It is therefore necessary that the developer be superior in flow, resistance to caking, fixability, charge property, and cleaning property. Especially, fine inorganic powder is often added to the surface of a toner so as to promote flow and resistance to caking.

However, fine inorganic powder has a considerable influence on the charge property of the toner. For example, because fine silica powder generally used has negative polarity, the fine silica powder increases the charge amount of the negative-polarity toner excessively, especially at a low temperature and low humidity. On the other hand, because fine silica powder takes in water under conditions of high temperature and high humidity, it acquires high electroconductivity and hence its charge property is reduced. Charging properties differ in both circumstances and result in the failure of density reproducibility, fogging on the background and copying failure caused by dirtying of the machine. The characteristics of the toner are also influenced by the dispersing condition of fine inorganic powder on the toner. When fine inorganic powder is dispersed unevenly on the toner, sufficient flow and resistance to caking cannot be attained. There are cases in which, in a cleaning process, toner remaining on the photoreceptor is removed insufficiently and the toner adheres to the photoreceptor, resulting in the occurrence of sunspot-like image failures and dropout.

In order to solve these problems, methods are proposed in which fine inorganic powder is surface-treated. For example, Japanese Patent Applications Laid-Open (JP-A) Nos. 46(1971)-5782, 48(1973)-47345, and 48(1973)-47346 disclose a method, in which the surface of fine silica powder is processed by a hydrophobic treatment for the purpose of preventing the adverse influence of water and the like. However, the use of such a fine inorganic powder alone cannot have sufficient effect in the prevention of the fluctuation of the charge property caused by environmental change, in the prevention of lowering of charging stability caused by long-term stress, and in the prevention of secondary damage to the photoreceptor.

There have been known methods to decrease the negative charge of fine silica powder added to the surface of a toner.

These methods include a method in which fine silica powder is surface-treated with an amino-modified silicone oil (see Japanese Patent Application Laid-Open (JP-A) No. 64(1989)-73354), and a method in which fine silica powder is surface-treated with aminosilane and/or amino-modified silicone oil (see Japanese Patent Application Laid-Open (JP-A) No. 1(1989)-237561). These treatments using amino compounds ensure restriction on the excess rise in the charge of negatively charged toner, but do not have sufficient effect in improving the fluctuation of the charge property of fine silica powder, which property is caused by environmental change. More specifically, using these treatments, fine silica powder can only be slightly suppressed from being excessively negatively charged after long-term operation of the apparatus at low temperature and low humidity. However, because the charge of fine silica powder is also neutralized by these treatments after long-term operation of an apparatus at a high temperature and high humidity, the charge fluctuation caused by environmental change has not been able to be improved yet. When a polyester resin or an epoxy resin is used as the binder resin for the toner, charging properties differ greatly between conditions of high temperature and high humidity and conditions of low temperature and low humidity.

From the above points of view, a method for adding an inorganic compound other than silica to the surface of a toner has been investigated. For example, a method in which an inorganic oxide such as titanium oxide having a low charge property or the like is added to the surface of a toner has been proposed (see Japanese Patent Application Laid-Open (JP-A) Nos. 58(1983)-216252, 60(1985)-123862, and 60(1985)-238847).

However, because titanium oxide is produced by purifying and baking titanium oxyhydrate ($TiO(OH)_2$) obtained by treating an ilmenite ore using a sulfuric acid process (wet process), it is only natural that aggregated particles occur due to dehydration and condensation in the product obtained using this process. It is not easy to disperse aggregated particles again using conventional techniques. Accordingly, crystallized titanium oxide (rutile: specific gravity of 4.2; anatase: specific gravity of 3.9) separated from the system of reaction as fine powder includes secondary and tertiary aggregated particles, so that a toner composition containing, as an external additive, titanium oxide is greatly inferior in improving flow compared to a toner composition containing, as an external additive, silica. Recently, there have been increasing numbers of requests in the market for improvement of high-quality images, especially high-quality color images and hence attempts have been made to produce a toner with a smaller particle diameter to achieve a high-quality image. However, as toner particles become finer, the adhering force between particles increases, whereby the flow of toner is further adversely affected. This phenomenon is greatly aggravated when titanium oxide is used as an external additive which is added to the surface of the toner.

Because of this, an attempt has been made to add both hydrophobic titanium oxide and hydrophobic silica to the surface of the toner, in order to improve the flow and prevent fluctuation in the charge property caused by environmental change (see Japanese Patent Application Laid-Open (JP-A) No. 60(1985)-136755). Using this process, the drawbacks of hydrophobic titanium oxide and hydrophobic silica can be temporarily eliminated. However, it is difficult to control the dispersing conditions of both on the surface of the toner in a stable manner and hence the characteristics of either hydrophobic titanium oxide or hydrophobic silica tends to be exhibited. Accordingly, it is difficult to cover the drawbacks of both together over the long term.

As another method for achieving both improvement in flow and the prevention of fluctuation in the charge property caused by environmental change, a method in which hydrophobic amorphous titanium oxide is added to the surface of a toner has been proposed (see Japanese Patent Application Laid-Open (JP-A) Nos. 5(1993)-204183 and 5(1993)-72797). The above amorphous titanium oxide can be prepared by hydrolyzing a metal alkoxide or a metal halide using a CVD process (see Chemical Engineering Articles Vol. 18, No. 3, 303–307, 1992).

However, because amorphous titanium oxide contains a large amount of adsorbed water within particles, it tends to adhere to the photoreceptor, so that amorphous titanium oxide remains on the photoreceptor in the transferring process. This hard amorphous titanium oxide residue may damage the photoreceptor in the cleaning process, or may cause dropout, if it cannot be removed from the photoreceptor by cleaning.

As methods for producing titanium oxide through the wet process, a method has been proposed wherein a coupling agent is hydrolyzed in an aqueous medium and the surface of the titanium oxide is treated with a hydrolyzed coupling agent to obtain hydrophobic titanium oxide which is suppressed from aggregating, followed by adding hydrophobic titanium oxide to a toner (see Japanese Patent Application Laid-Open (JP-A) No. 5(1993)-188633).

The hydrophobic titanium oxide produced in this method using a silane coupling agent improves the charging property of a negatively charged toner and the flow of toner in the early stages. However, the treating agent (silane coupling agent) for titanium oxide, which is added to the surface of the toner, tends to peel off the surface of the toner due to the collision of the toner with a carrier or the friction of the toner with a blade or a sleeve which are caused by agitation, whereby the charging property of the toner fluctuates greatly. Specifically, this method causes the life of the developer to be greatly shortened. Although the mechanism behind this phenomenon is not clear, it is hypothesized that this phenomenon is caused for the following reason: Specifically, even though titanium oxide reacts with the silane coupling agent, the binding force therebetween is significantly lower than the binding force, for example, between silica and aminosilane, because titanium oxide is lower in alkalinity. Also, titanium oxide has a few hydroxyl groups which are activated and there are limitations to the amount of silane compound used for the treatment (this amount contributes to the charge property), demonstrating the problem that a highly negative polarity cannot be obtained even in the early stages.

On the other hand, it is generally known that a titanium coupling agent strongly binds with titanium oxide. However, in the above method for treating titanium oxide by utilizing the wet process, it is necessary that a treating agent be dissolved or dispersed in water. Therefore, it is difficult to use a titanium coupling agent because titanium coupling agents have long molecular chains and hence most of these are insoluble in water. Also, only one titanium coupling agent which is soluble in water is a titanium coupling agent containing an amino group. This coupling agent has the capability of providing a positive charge, which makes it unsuitable for a treating agent used for an external additive for a negatively charged toner. Also, in titanium oxide produced in this method, the amount of secondary and tertiary aggregated particles is reduced, so that titanium oxide remains on a toner as primary particles, whereby the flow of toner is improved. However, the adhering condition of the titanium oxide to the toner is greatly changed from that at an early stage due to long-term stress. Therefore, the amount of charge of a toner used to supplement a developer during the operation of an apparatus is different from that of a toner included in developer before the adding of new toner, leading to inferior charging which is thought to be caused by the difference between the amounts of charge of toners. This causes the dirtying of a machine, fogging on the background, and the like.

As a method for forming full-color electrophotographic images in which full colors are rendered using toners of three colors of yellow, magenta, and cyan, or four colors consisting of those three colors and black, for example, there is a method in which a process including charging, exposure, and developing is repeated for each color to superimpose toners on a photoreceptor, then toner images are transferred to a transfer media, and the full-color images on the transfer media are fixed.

It is strongly desired that color toners used in such a method for forming color images not be mixed in individual developing steps and that they have transparency so that the colors of toners, especially underlying toners, are not damaged when these toners are superimposed.

Among these, it is known that the transparency of a color toner decreases as the amount of an external additive added to the surface of the toner increases. Transparency is especially remarkably reduced when titanium oxide is used as the external additive. Specifically, if the amount of titanium oxide is increased to improve the flow of toner, the transparency of the toner deteriorates extremely.

On the other hand, there has been an attempt to improve a carrier. For example, a method for reproducing high-quality images accurately, especially half tone, black solid, and printed characters, by controlling the volumetric specific resistance of a carrier is proposed. (see Japanese Patent Applications Laid-Open (JP-A) Nos. 56(1981)-125751 and 62(1987)-267766, and Japanese Patent Application Publication (JP-B) No. 7(1995)-120086).

In all of these methods, the resistance of the carrier is controlled by selecting a suitable material for a coating layer of the carrier or by controlling the amount of the coating layer. Using these measures, the desired volumetric specific resistance and a high-quality images can be obtained at an early stage. However, peeling of the carrier coating layer and the like caused by the stress generated in a developing unit occur, whereby the volumetric specific resistance of the carrier is greatly changed. Therefore, it is difficult to maintain high-quality images over the long term.

A method for controlling the volumetric specific resistance of a carrier by adding carbon black to the coating layer of the carrier is also proposed (see Japanese Patent Application Laid-Open (JP-A) No. 4(1992)-40471).

This method is useful for suppressing the fluctuation of the volumetric specific resistance of the carrier caused by the peeling of the coating layer. However, the external additive added to the surface of the toner or toner components adhere to the carrier, whereby the volumetric specific resistance of the carrier is changed. Therefore, it is still difficult to supply high-quality images over the long term.

SUMMARY OF THE INVENTION

The present invention has been achieved in view of the situation of the above prior art and the object of the present invention is to provide a developer for developing electrostatic latent images, which can exhibit a negative charge property in a stable manner without a reduction in the frictional charge property of toner, which suppresses the fluctuation of the charge property of the toner caused by environmental change, which is improved in flow and resistance to caking, which does not damage the photoreceptor, which has resistance to the development of an image defect, which does not cause a large change in the volumetric specific resistance of a carrier over the long term, and which renders high-quality images precisely, especially half tone images, black solid images, and printed characters.

Another object of the present invention is to provide an image forming method having the above advantages.

A further object of the present invention is to provide a multicolor image forming method which can reduce fluctuation of the charge property of toner caused by environmental change; which can improve the flow, resistance to caking, charge distribution, and transparency which is an important characteristic for a color toner; and which can avoid color mixing efficiently.

A still further object of the present invention is to provide a multicolor image forming method which can avoid the occurrence of image defects and damage to the photoreceptor and can form excellent images.

The present inventors have continued extensive studies to achieve the above objects and, as a result, have found that the above first object can be attained by a developer comprising a carrier and a toner composition wherein the carrier has, on a core, a resin coating layer in which an electroconductive material is dispersed in a matrix resin and the toner composition includes toner particles containing a binder resin and a colorant, and an external additive containing a titanium compound produced by the reaction of $TiO(OH)_2$ with a silane compound.

In the present invention, the titanium compound produced by the reaction between $TiO(OH)_2$ and the silane compound is used as the external additive which is added to the surface of toner particles. Therefore, the dispersibility of the external additive is improved and the adhering of the external additive to the toner particles is reduced, thereby preventing the external additive and toner components from transferring to the carrier and hence reducing the fluctuation of the volumetric specific resistance of the carrier. Also, the electroconductive material is dispersed in a resin coating layer of the carrier, so that the volumetric specific resistance of the carrier does not greatly change even if the resin coating layer peels off. As a result, it is possible to form high-quality images over the long term.

Also, yet another object of the present invention can be attained by an image forming method comprising a step of forming electrostatic latent images on a latent image forming substrate and a step for developing the electrostatic latent images using a developer on a developer carrying substrate, wherein the above developer is used.

A further object of the present invention can be attained by a multicolor image forming method comprising a step of forming electrostatic latent images on a latent image forming substrate and a step for developing the electrostatic latent images by a plurality of developers to form multicolor toner images, wherein the developer includes toner particles containing at least a binder resin and a colorant, and, as an external additive, a titanium compound which is produced by the reaction of $TiO(OH)_2$ with a silane compound and which has a BET specific surface area of from 40 to 250 $m^2/g$.

The present inventors have found that the particle size distribution of fine particles of the external additive has an influence on the characteristics of the toner, especially flow, and toner admixing capability and charging stability relating to long-term stress. Although this mechanism is not clear, it is hypothesized as follows: when the particle size of a titanium compound is smaller, the curvature of the titanium compound becomes larger. Also, in the case of adding a titanium compound to the surface of toner particles, a titanium compound having a particle diameter of a smaller size is more increased in the coverage on the surface of the toner than in that of a titanium compound having a particle diameter of a larger size if it is formulated in the same amount. From these reasons, the nonelectrostatic adhering force of the toner per a contact area and a unit area becomes small. As a result, the nonelectrostatic force between toners is lower, whereby the flow of the toner is improved.

In addition, the specific surface area of a titanium compound is increased by reducing the particle size of the titanium compound. It is, therefore, considered that the titanium compound may be added only in a reduced amount to have the same effect on the prevention of fluctuation of the charge property caused by environmental change and on the improvement of flow as in the case where a conventional titanium oxide is added, whereby the transparency of the color toner, which is one of the characteristics required for a color toner, is improved.

DETAILED DESCRIPTION OF THE PREFERRED EMBODIMENT

Figure 1:
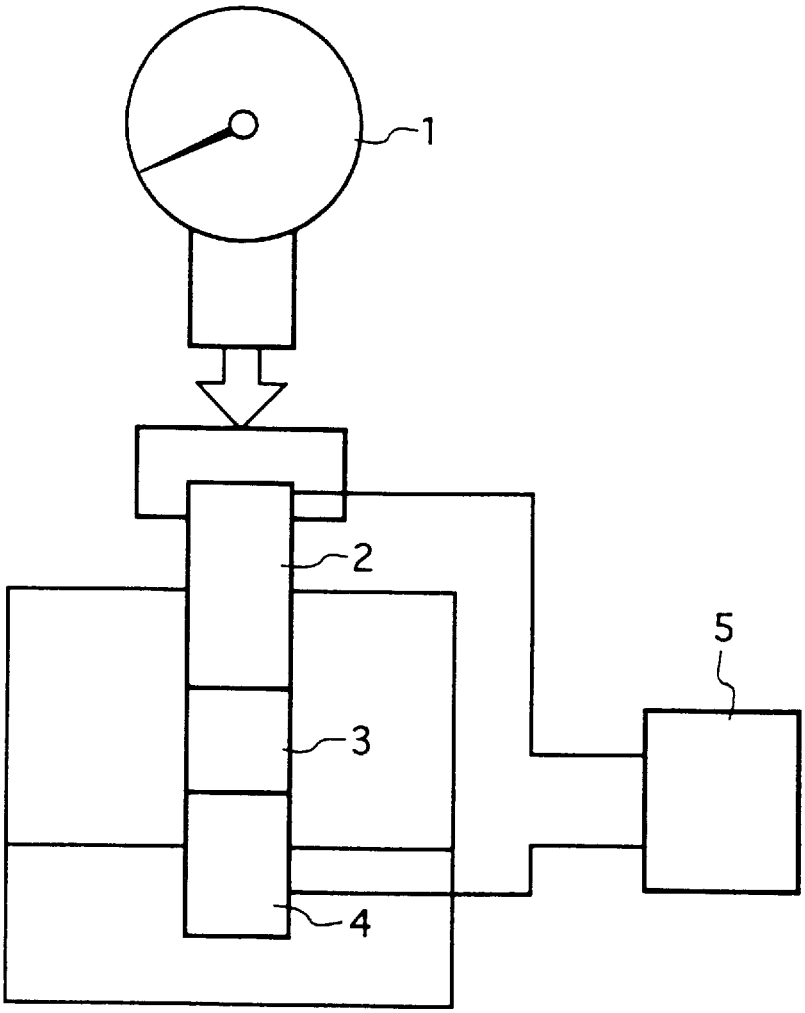
FIG. 1 is a view schematically showing an apparatus used for measuring resistance.

The present invention will now be explained in detail.

The developer of the present invention for developing electrostatic latent images includes a toner composition. The toner composition includes toner particles containing a binder resin and a colorant, and an external additive.

The above external additive contains a titanium compound (a compound including titanium oxide as a major component, hereinafter called "specific titanium oxide") prepared by reacting $TiO(OH)_2$ with a silane compound.

$TiO(OH)_2$ can be produced using a sulfuric acid process (wet process) using ilmenite ore according to the following chemical formula:

$$FeTiO_2+2H_2SO_4 \rightarrow FeSO_4+TiOSO_4+2H_2O$$

$$TiOSO_4+2H_2O \rightarrow TiO(OH)_2+H_2SO_4$$

A specific titanium oxide can be produced by adding a silane compound to $TiO(OH)_2$, preferably $TiO(OH)_2$ dispersed in water, and by treating all or part of OH groups with the silane compound, followed by filtering, washing, drying, and pulverizing of the resultant product. Specific titanium oxide thus produced can possess a lower specific gravity than that of a conventional crystallized titanium oxide produced by baking $TiO(OH)_2$ prepared using a sulfuric acid process. When the reaction is carried out in a solution in the above manner, $TiO(OH)_2$ is treated using a hydrolyzed compound of the silane compound at the time when the silane compound is hydrolyzed. Thus, $TiO(OH)_2$ is surface-treated with the silane compound in the state of a primary particle. It is possible to produce specific titanium oxide in the state of a primary particle, in other words, having a few aggregated particles. It is therefore possible to provide a developer which has an excellent charge property, flow, resistance to caking, and negative charge property, and for which the fluctuation of the charge property caused by environmental change is reduced, whereby images of stable quality can be exhibited. It is also possible to provide color images which is superior in the prevention of color mixing and transparency required for a color toner.

In the above reaction, the specific gravity and negative charge property of a specific titanium oxide can be finely controlled by selecting the type and amount of the silane compound used for treatment. If the amount of the silane compound used for treatment is large, a specific titanium oxide with a small specific gravity and a high charge-providing capability is produced, whereas if the amount of the silane compound used for treatment is small, a specific titanium oxide with a large specific gravity and a low charge-providing capability is produced.

In this invention, the specific gravity of specific titanium oxide is controlled preferably in a range from 2.8 to 3.6, and more preferably from 3.0 to 3.5. If the specific gravity of specific titanium oxide is less than 2.8, it is necessary to add a surplus silane compound to $TiO(OH)_2$. Because of this, the silane compounds react with each other and hence aggregated particles of the specific titanium oxide may be produced, and, as a result, the desired flow is not obtained. Further, if the specific gravity of a specific titanium oxide exceeds 3.6, the specific titanium oxide can be uniformly dispersed on the surface of toner particles only with difficulty when blending toner particles with the specific titanium oxide. Also, even if the specific titanium oxide is uniformly dispersed on the surface of toner particles when these are blended, a specific titanium oxide existing in the convex portion of toner particles is transferred to the concave portion of toner particles, whereby the flow and charge property of the toner are reduced or the specific titanium oxide existing on the convex portion tends to separate off. In a two-component developer, the separated specific titanium oxide is transferred to the surface of the carrier and hence the volumetric specific resistance of the carrier changes greatly, whereby the formation of excellent images cannot be maintained over the long term.

As the above silane compound, compounds which are soluble in water may be used.

As such a silane compound, compounds represented by the chemical formula $R_aSiX_{4-a}$, wherein a denotes an integer of from 0 to 3, R represents a hydrogen atom or an organic group such as an alkyl group or alkenyl group, and X represents a chlorine atom or hydrolyzable group such as a methoxy group or ethoxy group, may be used. Any type of chlorosilane, alkoxysilane, silazane, and specific silylcating agents can be used. Specific examples of the silane compound include methyltrichlorosilane, dimethyldichlorosilane, trimethylchlorosilane, phenyltrichlorosilane, diphenyldichlorosilane, tetramethoxysilane, methyltrimethoxysilane, dimethyldimethoxysilane, phenyltrimethoxysilane, diphenyldimethoxysilane, tetratethoxysilane, methyltriethoxysilane, dimethyldiethoxysilane, phenyltriethoxysilane, diphenyldiethoxysilane, isobutyltrimethoxysilane, decyltrimethoxysilane, hexamethyldisilazane, N,O-(bistrimethylsilyl)acetamide, N,N-bis(trimethylsilyl)urea, tert-butyldimethylchlorosilane, vinyltrichlorosilane, vinyltrimethoxysilane, vinyltriethoxysilane, γ-methacryloxypropyltrimethoxysilane, β-(3,4-epoxycyclohexyl) ethyltrimethoxysilane, γ-glycidoxypropyltrimethoxysilane, γ-glycidoxypropylmethyldiethoxysilane, γ-mercaptopropyltrimethoxysilane, and γ-chloropropyltrimethoxysilane. Among these, silane compounds especially preferred as the treating agent in this invention are dimethyldimethoxysilane, hexamethyldisilazane, methyltrimethoxysilane, isobutyltrimethoxysilane, decyltrimethoxysilane, and the like.

In the case of a black toner, the proportion of the silane compound is generally from 1 to 250 parts by weight, and preferably from 50 to 200 parts by weight, based on 100 parts by weight of $TiO(OH)_2$. On the other hand, in the case of a color toner, the proportion of the silane compound is generally from 2 to 50 parts by weight, and preferably from 5 to 20 parts by weight based on 100 parts by weight of $TiO(OH)_2$. Incidentally, after drying, $TiO(OH)_2$ may be treated with other compounds.

It is necessary that the BET specific surface area of specific titanium oxide added to a color toner be from 40 to 250 $m^2/g$. If the BET specific surface area of the specific titanium oxide is less than 40 $m^2/g$, the flow of toner is impaired, while it is difficult to produce specific titanium oxide having a BET specific surface area exceeding 250 $m^2/g$. The BET specific surface area of the specific titanium oxide is preferably from 60 to 200 $m^2/g$, and more preferably from 80 to 150 $m^2/g$.

It is preferable that the average particle diameter of primary particles of specific titanium oxide be from 5 to 50 nm to provide excellent flow.

On the other hand, known toner particles including a binder resin and a colorant as major components are used as toner particles for developing electrostatic latent images in this invention. Examples of the binder resin used in the present invention include polymers or copolymers of styrenes such as styrene, chlorostyrene, and the like; monoolefins such as ethylene, propylene, butylene, isoprene, and the like; vinyl esters such as vinyl acetate, vinyl propyonate, vinyl benzoate, vinyl butyrate, and the like; a-methylene aliphatic monocarboxylates such as methyl acrylate, ethyl acrylate, butyl acrylate, dodecyl acrylate, octyl acrylate, phenyl acrylate, methyl methacrylate, ethyl methacrylate, butyl methacrylate, dodecyl methacrylate, and the like; vinyl ethers such as vinyl methyl ether, vinyl ethyl ether, vinyl butyl ether, and the like; and vinyl ketones such as vinyl methyl ketone, vinyl hexyl ketone, vinyl isopropenyl ketone, and the like. Among these, especially typical examples are polystyrene, styrene-alkyl acrylate copolymer, styrene-alkyl methacrylate copolymer, styrene-acrylonitrile copolymer, styrene-butadiene copolymer, styrene-maleic anhydride copolymer, polyethylene, and polypropylene. Also, polyester, polyurethane, epoxy resins, silicone resins, polyamide, modified rosin, paraffin wax, and the like may be used as the binder resin.

Also, known colorants such as magnetic powder such as magnetite, ferrite, and the like; carbon black; cyan colorant such as copper phthalocyanine and the like; yellow colorant composed of azo compounds; magenta colorant composed of azo compounds; and magenta colorant such as quinacridone and the like are employed as the colorant used in the present invention. Specific examples of colorants include aniline blue, carcoyl blue, chrome yellow, ultramarine blue, Du Pont oil red, quinoline yellow, methylene blue chloride, phthalocyanine blue, malachite green-oxalate, lamp black, rosebengal, C. I. Pigment Red 48:1, C. I. Pigment Red 122, C. I. Pigment Red 57:1, C. I. Pigment Yellow 97, C. I. Pigment Yellow 17, C. I. Pigment Blue 15:1, and C. I. Pigment Blue 15:3.

In addition, the toner composition used in the present invention may include a charge control agent as required. As the charge control agent, known charge control agents such as metallic complex compounds of azo compounds, metallic complex compounds of salicylic acid, and charge control agents produced of resins containing a polar group can be used. Also, the toner composition may include waxes such as low molecular polypropylene and/or low molecular polyethylene and the like as an offset preventive agent. Also, the toner composition may include a magnetic material.

Toner particles (toner base body) used in the present invention can be manufactured by a process using conventional kneading, pulverizing, and classifying processes or a polymerization process. The shape of the toner particle may be undefined or spherical. The average particle diameter of toner particles is generally in a range from 3 to 15 $\mu$m, and preferably from 3 to 10 $\mu$m, to produce high image quality.

In the present invention, a specific titanium oxide is added to and mixed with toner particles. For the mixing, known mixers such as a V-type blender or Henschel mixer can be used. Also, in the mixing step, various external additives may be added to tonerparticles. Examples of such an external additive include another fluidizing agents, polystyrene fine particles, polymethyl methacrylate fine particles, cleaning auxiliaries such as polyvinylidene fluoride and the like and/or transferring auxiliaries. The proportion of specific titanium oxide is preferably in a range from 0.1 to 5 parts by weight based on 100 parts by weight of toner particles to ensure a balance between the flow, particle diameter, and specific gravity.

In this invention, specific titanium oxide fine particles may either adhere only mechanically to or be secured loosely to the surface of toner particles. Also, either all or part of the surface of toner particles may be coated with fine specific titanium oxide particles. Although fine specific titanium oxide particles on the surface of toner particles may contain a small amount of aggregated particles, it is desirable that fine specific titanium oxide particles exist on the surface of toner particles in a state of a single layer.

The toner composition in which toner particles and specific titanium oxide are blended may be screened.

The developer of the present invention may include a carrier. In this case, when toner particles and the carrier are mixed, the specific titanium oxide may be added to the mixture in order to simultaneously carry out the mixing of the toner with the carrier and the addition of the external additive to the toner surface.

Examples of a core of the carrier, which can be used in the present invention, include magnetic metals such as iron, nickel, cobalt, and the like; magnetic oxides such as ferrite, magnetite, and the like; and glass beads. In a magnetic brushing method, it is preferable to use a magnetic material as the carrier to control volumetric specific resistance of the carrier.

The average particle diameter of the core is generally in a range from 10 to 500 $\mu$m, and preferably from 30 to 100 $\mu$m.

The carrier which can be used in the present invention may have a resin coating layer on the core. The resin coating layer may be one in which an electroconductive material is dispersed in a matrix resin.

Examples of the matrix resin include, but are not limited to, polyethylene, polypropylene, polystyrene, polyacrylonitrile, polyvinyl acetate, polyvinyl alcohol, polyvinyl butyral, polyvinyl chloride, polyvinyl carbazole, polyvinyl ether, polyvinyl ketone, vinyl chloride-vinyl acetate copolymer, styrene-acrylic acid copolymer, straight silicone resins constituted of organosiloxane bonds or modified products of these, fluorine-contained resin, polyester, polyurethane, polycarbonate, phenol resins, amino resins, melamine resins, benzoguanamine resin, urea resins, amido resins, and epoxy resins.

Also, examples of the electroconductive material include, but are not limited to, metals such as gold, silver, copper, and the like; and titanium oxide, zinc oxide, barium sulfate, aluminum borate, potassium titanate, tin oxide, and carbon black.

The proportion of the electroconductive material is preferably in a range from 1 to 50 parts by weight, and more preferably from 3 to 20 parts by weight based on 100 parts by weight of the matrix resin.

Examples of the process for forming the resin coating layer on the core surface include a dipping process in which a carrier core is dipped into a coating layer forming liquid containing a matrix resin, electroconductive material, and a solvent; a spraying process in which a coating layer forming liquid is sprayed on the surface of a carrier core, a process in which a coating layer forming liquid is sprayed on a carrier core floated by an air flow, and a kneader coater process in which a carrier core and a coating layer forming liquid are mixed in a kneader coater followed by the removing of a solvent.

Examples of the solvent used in the coating layer forming solution include aromatic hydrocarbons such as toluene, xylene, and the like; ketones such as acetone, methyl ethyl ketone, and the like; and ethers such as tetrahydrofuran, dioxane, and the like, although there are no limitations as to the type of the solvent, to the extent that the solvent can dissolve the matrix resin.

The average film thickness of the resin coating layer is generally in a range from 0.1 to 10 $\mu$m, and preferably from 0.5 to 3 $\mu$m to stabilize the volumetric specific resistance of the carrier over the long term.

The volumetric specific resistance of the carrier formed in the above manner is preferably in a range from $10^6$ to $10^{12}$ Ωcm at a voltage ranging from $10^3$ to $10^4$ V/cm corresponding to the lower limit and to the upper limit of the ordinary developing contrast potential, respectively, to provide high-quality images. If the volumetric specific resistance of the carrier is less than 106 Ωcm, it is difficult to render fine lines, and toner fogging on the background tends to occur, caused by the injection of charge. On the other hand, if the volumetric specific resistance of the carrier is greater than $10^{12}$ Ωcm, it is difficult to render solid and half-tone. Also, the amount of carrier transferred to a photoreceptor increases, thereby sometimes damaging the photoreceptor.

Also, it is desirable that the ratio (X/Y) of the volumetric specific resistance X of the carrier to the volumetric specific resistance Y of the specific titanium oxide be in a range from 0.01 to 100. If the ratio (X/Y) is less than 0.01 or exceeds 100, the volumetric specific resistance of the carrier changes greatly when the external additive is transferred to the carrier.

A first image forming method in the present invention is that which comprises a step of forming electrostatic latent images on a latent image forming substrate and a step of developing the electrostatic latent images by a developer on a developer carrying substrate, and which uses a developer comprising a toner composition containing toner particles and a specific titanium oxide, and a carrier containing a core and a resin coating layer in which an electroconductive material is dispersed.

As the latent image forming substrate, an electrophotographic photoreceptor, dielectric recording medium, or the like is used and electrostatic latent images are formed using a known process. On the other hand, as the developer carrying substrate, for example, a substrate in which a magnetic roller is secured inside a nonmagnetic sleeve capable of rotating is used. The developer carrying substrate is disposed in opposition to the latent image forming substrate. In addition, the toner images formed on the latent image forming substrate are then transferred to transfer media using a known process.

A second image forming method in the present invention is a multicolor image forming method which comprises a step of forming electrostatic latent images on a latent image forming substrate and a step of developing the electrostatic latent images by a plurality of developers, thereby forming multicolor toner images, and which uses a developer which comprises a toner composition containing toner particles and a specific titanium oxide having a BET specific surface area of from 40 to 250 $m^2/g$. Formation and developing of the electrostatic latent images are, for example, carried out for every color in order. As a result, multicolor toner images are formed on the latent image forming substrate. These toner images are transferred to transfer media using a known transferring process and then fixed. Incidentally, in the process of the present invention for forming multicolor images, it is permissible that formation, development of electrostatic latent images, and transformation of toner images be carried out for every color in order and then only fixing of toner images be carried out once to produce multicolor images.

EXAMPLES

The present invention will be explained in more detail by way of examples, which are not intended to be limiting to the present invention. In the explanations below, "part(s)" indicates "part(s) by weight" unless otherwise noted.

In processes for manufacturing a toner composition, carrier, and developer, each measurement is carried out using the following process:

<Measurement of Specific Gravity of External Additive>

The specific gravity was measured using a Le Chatelier pycnometer according to JIS-K-0061, article 5-2-1. The operation for measurement was as follows:

(1) About 250 ml of ethyl alcohol was supplied to the Le Chatelier pycnometer and the amount of ethyl alcohol was controlled so that a meniscus was up to a prescribed graduation.

(2) The pycnometer was dipped into a constant-temperature water bath and the position of the meniscus was measured precisely when the temperature of the solution was at 20.0°±0.2° C. (an accuracy of 0.025 ml).

(3) 100.000 g of a sample was weighed and taken out. Here, the amount of sample is shown as "W".

(4) The sample, which was weighed and taken out, was charged into the pycnometer and the foam generated was removed.

(5) The pycnometer was dipped into the constant-temperature water bath and the position of the meniscus was measured precisely when the temperature of the solution was at 20.0°±0.2° C. (an accuracy of 0.025 ml).

(6) The specific gravity was calculated according to the following formula:

$$D=W/(L_2-L_1) \quad (1)$$

$$S=D/0.9982 \quad (2)$$

wherein D is the density (at 20° C.) ($g/cm^3$) of the sample, S is the specific gravity (at 20° C.) of the sample, W is the virtual mass (g) of the sample, $L_1$ is a value (at 20° C.) (ml) of the graduation position of the meniscus before the sample was charged into the pycnometer, $L_2$ is a value (at 20° C.) (ml) of the graduation position of the meniscus after the sample was charged into the pycnometer, the numeral 0.9982 is the density ($g/cm^3$) of water at 20° C.

<Measurement of Primary Particle Diameter of External Additive>

A disperse system in which an external additive was dispersed into an epoxy resin (resin in which two fluids were cured) was sliced using a microtome to prepare a sample with a thickness of 0.1 μm. The sample was subjected to analysis which was carried out using transmission electron microscopy (TEM) (JEM 1010, manufactured by JEOL Ltd.) at an acceleration voltage of 80 kV to obtain a photographic image, which was then studied to determine the primary particle diameter of the external additive.

<Measurement of Resistance>

As shown in FIG. 1, a sample 3 was supported between a lower electrode 4 and an upper electrode 2. Pressure was applied to the sample 3 from above, and then the thickness of the sample was measured using a dial gauge. The electrical resistance of the sample 3 for the external additive was measured using a high-voltage resistancemeter 5. Specifically, a pressure of 500 $kg/cm^2$ was applied to the sample 3 using a forming machine to make a disk for measurement. The surface of the disk was cleaned using a brush. The disk was then sandwiched between the upper electrode 2 and the lower electrode 4, which were positioned within a cell. The thickness of the sample 3 was then measured using a dial gauge. Next, voltage was applied to the sample 3 and the current value was read to determine the volumetric specific resistance of the sample 3.

Also, the sample for a carrier was placed on a lower electrode 4 with a diameter of 100 mm, the upper electrode 2 was set in place, a pressure of 3.43 kg was applied to the upper side of the upper electrode 2, and the thickness of the sample was measured. Next, voltage was applied to the sample and the current value was read to determine the volumetric specific resistance of the sample.

Further, a carrier separated out by removing the toner composition from the developer using a blowoff process before and after taking 200,000 copies was tested in the same manner as above (result of evaluation using an actual machine).

The volumetric specific resistance was calculated according to the following formula:

$$\rho = \frac{V \times S}{(I - I_0) \times H}$$

$$E = \frac{V}{H}$$

wherein ρ is the volumetric specific resistance (Ωcm), V is the applied voltage (V), I is the current (A), $I_0$ is the initial current (A), S is the surface area of an electrode ($cm^2$), H is the thickness of a sample (cm), and E is an electrical field (V/cm).

<Determination of Toner Flow>

The dispensed amount of a toner composition was measured using an offline auger dispenser. Using a dispensed amount of 800 mg/s as a standard, pass or fail was decided.

<Measurement of Charge Amount>

(1) Both a toner composition and a carrier were allowed to stand for 24 hours under conditions of high temperature and high humidity (30° C., 90% RH) and under conditions of low temperature and low humidity (5° C., 10% RH). Then, the toner composition and the carrier were sampled in a bottle having a lid so that a toner concentration (TC) was 5% and subjected to turbula agitation under the respective conditions to produce the respective developers. The charge amounts of agitated developers were respectively measured at 25° C. under 55% RH using a TB 200 (manufactured by Toshiba Corporation).

(2) Developer remaining on the developing sleeve inside the developing machine was sampled for an evaluation test using an actual machine. The amount of charge of the sample was measured under the same conditions as above (at 25° C. under 55% RH using a TB 200 manufactured by Toshiba Corporation).

<Solid Area Density>

The solid area density was measured using a X-Rite 404A (X-Rite).

(Preparation of External Additive)

In this example, a wet sedimentation process was used wherein ilmenite ore was dissolved in sulfuric acid to separate iron and the resultant $TiOSO_4$ was then hydrolyzed to prepare $TiO(OH)_2$. These steps include steps of dispersing and washing in water for the hydrolysis and the generation of a core.

Preparation of External Additive (a)

50 parts of isobutyltrimethoxysilane were added dropwise to 100 parts of $TiO(OH)_2$, which was prepared in the above manner and which was dispersed in 500 ml of water, while the mixture was agitated at room temperature. Then, filtration and washing of the product with water were repeated to obtain a titanium compound which was surface-treated with isobutyltrimethoxysilane. The titanium compound was dried at 150° C. and pulverized for two minutes using a sample mill to obtain External Additive (a) having a specific gravity of 3.3, an average primary particle diameter of 30 nm, and a volumetric specific resistance of $10^{10}$ Ωcm at an electrical field of 1,000 V/cm.

Preparation of External Additive (b)

80 parts of isobutyltrimethoxysilane were added dropwise to 100 parts of $TiO(OH)_2$, which was prepared in the above manner and which was dispersed in 500 ml of water, while the mixture was agitated at room temperature. Then, filtration and washing of the product with water were repeated to obtain a titanium compound which was surface-treated with isobutyltrimethoxysilane. The titanium compound was dried at 150° C. and pulverized for two minutes using a sample mill to obtain External Additive (b) having a specific gravity of 2.8, an average primary particle diameter of 30 nm, and a volumetric specific resistance of $10^{12}$ Ωcm at an electrical field of 1,000 V/cm.

Preparation of External Additive (c)

20 parts of isobutyltrimethoxysilane were added dropwise to 100 parts of $TiO(OH)_2$, which was prepared in the above manner and which was dispersed in 500 ml of water, while the mixture was agitated at room temperature. Then, filtration and washing of the product with water were repeated to obtain a titanium compound which was surface-treated with isobutyltrimethoxysilane. The titanium compound was dried at 150° C. and pulverized for two minutes using a sample mill to obtain External Additive (c) having a specific gravity of 3.5, an average primary particle diameter of 30 nm, and a volumetric specific resistance of $10^{8}$ Ωcm at an electrical field of 1,000 V/cm.

Preparation of External Additive (d)

20 parts of isobutyltrimethoxysilane were added dropwise to 100 parts of $TiO(OH)_2$, which was prepared in the above manner and which was dispersed in 500 ml of water, while the mixture was agitated at room temperature. Then, filtration and washing of the product with water were repeated to obtain a titanium compound which was surface-treated with isobutyltrimethoxysilane. The titanium compound was dried at 180° C. and pulverized for two minutes using a sample mill to obtain External Additive (d) having a specific gravity of 3.6, an average primary particle diameter of 30 nm, and a volumetric specific resistance of $10^{7}$ Ωcm at an electrical field of 1,000 V/cm.

Preparation of External Additive (e)

20 parts of decylsilane were added dropwise to 100 parts of $TiO(OH)_2$, which was prepared in the above manner and which was dispersed in 500 ml of water, while the mixture was agitated at room temperature. Then, filtration and washing of the product with water were repeated to obtain a titanium compound which was surface-treated with decylsilane. The titanium compound was dried at 150° C. and pulverized for two minutes using a sample mill to obtain External Additive (e) having a specific gravity of 3.3, an average primary particle diameter of 40 nm, and a volumetric specific resistance of $10^{10}$ Ωcm at an electrical field of 1,000 V/cm.

Preparation of External Additive (f)

$TiO(OH)_2$ prepared in the above manner was sufficiently washed, and then filtered and dried, followed by baking at about 1,000° C. in a rotary kiln to obtain crystallized titanium oxide. The crystallized titanium oxide was then wet-milled and bulky particles were removed from the titanium oxide. 20 parts of isobutyltrimethoxysilane were added to 100 parts of crystallized titanium oxide. The treated crystallized titanium oxide was filtered and washed with water, followed by drying at 150° C. to prepare External Additive (f) having a specific gravity of 3.9, an average primary particle diameter of 40 nm, and a volumetric specific resistance of $10^{7}$ Ωcm at an electrical field of 1,000 V/cm.

Preparation of External Additive (g)

15 parts of isobutyltrimethoxysilane were added dropwise to 100 parts of $TiO(OH)_2$, which was prepared in the above manner and which was dispersed in 1,000 ml of water, while the mixture was agitated at room temperature. Then, filtration and washing of the product with water were repeated to obtain a titanium compound which was surface-treated with isobutyltrimethoxysilane. The titanium compound was dried at 150° C. to prepare External Additive (g) having a BET specific surface area of 100 $m^2/g$ and a specific gravity of 3.5.

Preparation of External Additive (h)

External Additive (h) having a BET specific surface area of 150 $m^2/g$ and a specific gravity of 3.2 was prepared in the same manner as in the preparation of External Additive (g) except that 10 parts of isobutyltrimethoxysilane were used.

Preparation of External Additive (i)

External Additive (i) having a BET specific surface area of 200 $m^2/g$ and a specific gravity of 3.2 was prepared in the same manner was in the preparation of External Additive (g) except that 25 parts of isobutyltrimethoxysilane were used.

Preparation of External Additive (j)

20 parts of methyltrimethoxysilane were added dropwise to 100 parts of $TiO(OH)_2$, which was prepared in the above manner and which was dispersed in 1,000 ml of water, while the mixture was agitated at room temperature. Then, filtration and washing of the product with water were repeated to obtain a titanium compound which was surface-treated with methyltrimethoxysilane. The titanium compound was dried at 180° C. to prepare External Additive (j) having a BET specific surface area of 250 $m^2/g$ and a specific gravity of 3.1.

Preparation of External Additive (k)

External Additive (k) having a BET specific surface area of 40 $m^2/g$ and a specific gravity of 2.8 was prepared in the same manner as in the preparation of External Additive (j) except that 10 parts of methyltrimethoxysilane were used.

Preparation of External Additive (m)

External Additive (m) having a BET specific surface area of 100 $m^2/g$ and a specific gravity of 3.0 was prepared in the same manner as in the preparation of External Additive (j) except that 25 parts of methyltrimethoxysilane were used.

Preparation of External Additive (n)

External Additive (n) having a BET specific surface area of 10 $m^2/g$ and a specific gravity of 3.6 was prepared in the same manner as in the preparation of External Additive (j) except that 5 parts of methyltrimethoxysilane were used.

Preparation of External Additive (o)

100 parts of $TiO(OH)_2$ were heated at 700° C. and wet-milled. 20 parts of isobutyltrimethoxysilane were added to the resultant titanium oxide. The treated titanium oxide was heated at 200° C. This titanium oxide was filtered in wet condition (slurry state), washed with water, dried, and dry-pulverized to prepare External Additive (o) having a BET specific surface area of 100 $m^2/g$ and a specific gravity of 4.2.

Preparation of External Additive (p)

100 parts of $TiO(OH)_2$ were heated at 700° C. and wet-milled. 20 parts of methyltrimethoxysilane were added to the resultant titanium oxide. The treated titanium oxide was heated at 150° C. This titanium oxide was filtered in wet condition (slurry state), washed with water, dried, and dry-pulverized to prepare External Additive (p) having a BET specific surface area of 120 $m^2/g$ and a specific gravity of 3.9.

Preparation of External Additive (g)

3 parts of methyltrimethoxysilane were added to 100 parts of $TiO(OH)_2$. The resultant titanium compound was heated at 120° C. Then, the resultant titanium oxide was filtered in wet condition (slurry state), washed with water, dried, and dry-pulverized to prepare External Additive q having a BET specific surface area of 270 $m^2/g$ and a specific gravity of 3.6.

(Preparation of carrier)
Preparation of Carrier A

| | Part (s) |
|---|---|
| Ferrite particles [Average particle diameter: 50 μm] | 100 |
| Toluene | 14 |
| Styrene-methacrylate copolymer [Copolymerization ratio: 90:10, Mw: 100,000] | 2 |
| Carbon black [R330, manufactured by Cabot Co., Ltd.] | 0.2 |

The above components, excluding the ferrite particles, were agitated with a stirrer for 10 minutes and dispersed to prepare a coating liquid. The coating liquid and ferrite particles were then placed in a kneader from which air was evacuated by using a vacuum and agitated at 60° C. for 30 minutes. While the mixture was further heated, the pressure in the kneader was reduced to distill toluene. The resultant particles were dried to obtain Carrier A. Carrier A had a volumetric specific resistance of $10^{11}$ Ωcm at an electrical field of 1,000 V/cm.

Preparation of Carrier B

| | Part (s) |
|---|---|
| Ferrite particles [Average particle diameter: 50 μm] | 100 |
| Toluene | 14 |
| Styrene-methacrylate copolymer [Copolymerization ratio: 90:10, Mw: 100,000] | 2 |
| Carbon black [R330, manufactured by Cabot Co., Ltd.] | 0.6 |

The above components, excluding the ferrite particles, were agitated with a stirrer for 10 minutes and dispersed to prepare a coating liquid. The coating liquid and ferrite particles were then placed in a kneader from which air was evacuated by using a vacuum and agitated at 60° C. for 30 minutes. While the mixture was further heated, the pressure in the kneader was reduced to distill toluene. The resultant particles were dried to obtain Carrier B. Carrier B had a volumetric specific resistance of $10^8$ Ωcm at an electrical field of 1,000 V/cm.

Preparation of Carrier C

| | Part (s) |
|---|---|
| Ferrite particles [Average particle diameter: 50 μm] | 100 |
| Toluene | 14 |
| Styrene-methacrylate copolymer [Copolymerization ratio: 90:10, Mw: 100,000] | 2 |

The above components, excluding the ferrite particles, were agitated with a stirrer for 10 minutes and dispersed to prepare a coating liquid. The coating liquid and ferrite particles were then placed in a kneader from which air was evacuated by using a vacuum and agitated at 60° C. for 30 minutes. While the mixture was further heated, the pressure in the kneader was reduced to distill toluene. The resultant particles were dried to obtain Carrier C. Carrier C had a volumetric specific resistance of $10^{14}$ Ωcm at an electrical field of 1,000 V/cm.

Example 1

<Preparation of toner particles>

| | Part (s) |
|---|---|
| Binder resin [Bisphenol-type polyester resin prepared from an ethylene oxide adduct of bisphenol A and terephthalic acid, Mw: $9.6 \times 10^5$, Mn: $4.7 \times 10^3$, Tg: 59° C.] | 100 |
| Carbon black [BPL, manufactured by Cabot Co., Ltd.] | 5 |
| Charge control agent [BONTRON E84, manufactured by Orient Chemical Co., Ltd.] | 2 |

The above components were made molten and kneaded using a Banbury mixer. The resultant composition was cooled, then pulverized using a jet mill, and further classified using a classifier to obtain toner particles with an average particle diameter of 6 μm. 100 parts of the toner particles and 1.0 part of External Additive (a) were mixed in a Henschel mixer to prepare a toner composition.

<Preparation of Developer>

5 parts of the toner composition and 95 parts of Carrier A were mixed using a V-type blender to obtain a developer.

Example 2

A developer was prepared in the same manner as in Example 1 except that External Additive (b) was used instead of External Additive (a).

Example 3

A developer was prepared in the same manner as in Example 1 except that External Additive (c) was used instead of External Additive (a).

Example 4

A developer was prepared in the same manner as in Example 1 except that External Additive (d) was used instead of External Additive (a).

Example 5

A developer was prepared in the same manner as in Example 1 except that External Additive (e) was used instead of External Additive (a).

Example 6

A developer was prepared in the same manner as in Example 1 except that Carrier B was used instead of Carrier A.

Example 7

A developer was prepared in the same manner as in Example 2 except that Carrier B was used instead of Carrier A.

Example 8

A developer was prepared in the same manner as in Example 3 except that Carrier B was used instead of Carrier A.

Example 9

A developer was prepared in the same manner as in Example 5 except that Carrier B was used instead of Carrier A.

Comparative Example 1

A developer was prepared in the same manner as in Example 1 except that External Additive (f) was used instead of External Additive (a).

Comparative Example 2

A developer was prepared in the same manner as in Example 1 except that Carrier C was used instead of Carrier A.

Comparative Example 3

A developer was prepared in the same manner as in Example 1 except that amorphous titanium oxide was used instead of External Additive (a).

These developers were used to carry out a copying test by taking 200,000 copies using a copying machine (A-COLOR 635, manufactured by Fuji Xerox Co., Ltd.). The results are shown in Table 1.

TABLE 1

| | External additive | | | Carrier | | | | Amount of charge (μc/g) | |
|---|---|---|---|---|---|---|---|---|---|
| | No. | Specific gravity (particle diameter) | Resistance Y (Ωcm) | No. | Resistance X (Ωcm) | X/Y | Toner flow (mg/s) | High temperature, high humidity | Low temperature, low humidity |
| Ex. 1 | a | 3.3 (30 nm) | $10^{10}$ | A | $10^{11}$ | 10 | 900 ○ | −27 | −30 |
| Ex. 2 | b | 2.8 (30 nm) | $10^{12}$ | A | $10^{11}$ | $10^{-1}$ | 1000 ○ | −30 | −35 |
| Ex. 3 | c | 3.5 (30 nm) | $10^{8}$ | A | $10^{11}$ | $10^{3}$ | 850 ○ | −23 | −25 |
| Ex. 4 | d | 3.6 (30 nm) | $10^{7}$ | A | $10^{11}$ | $10^{4}$ | 830 ○ | −18 | −20 |
| Ex. 5 | e | 3.3 (40 nm) | $10^{10}$ | A | $10^{11}$ | 10 | 800 ○ | −26 | −28 |

TABLE 1-continued

| | | | | | | | | | |
|---|---|---|---|---|---|---|---|---|---|
| Ex. 6 | a | 3.3 (30 nm) | $10^{10}$ | B | $10^{8}$ | $10^{-2}$ | 900 ○ | −27 | −30 |
| Ex. 7 | b | 2.8 (30 nm) | $10^{12}$ | B | $10^{8}$ | $10^{-4}$ | 1000 ○ | −29 | −33 |
| Ex. 8 | c | 3.5 (30 nm) | $10^{8}$ | B | $10^{8}$ | 1 | 850 ○ | −20 | −23 |
| Ex. 9 | e | 3.3 (40 nm) | $10^{10}$ | B | $10^{8}$ | $10^{-2}$ | 800 ○ | −22 | −25 |
| Comp. Ex. 1 | f | 3.9 (40 nm) | $10^{7}$ | A | $10^{11}$ | $10^{4}$ | 700 X | −19 | −24 |
| Comp. Ex. 2 | a | 3.3 (30 nm) | $10^{10}$ | C | $10^{14}$ | $10^{4}$ | 900 ○ | −36 | −40 |
| Comp. Ex. 3 | #1 | 3.7 (30 nm) | $10^{8}$ | A | $10^{11}$ | $10^{3}$ | 600 | −23 | −30 |

| | Actual machine evaluation | | | | | | | |
|---|---|---|---|---|---|---|---|---|
| | Initial stage | | | | After 200,000 Copies | | | |
| | Amount of charge (μC/G) | SAD | Resistance X (Ωcm) | Image quality (defect) | Amount of charge (μc/g) | SAD | Resistance X (Ωcm) | Image quality (defect) |
| Ex. 1 | −28 | 1.50 ○ | $10^{11}$ | No problem | −26 | 1.49 ○ | $10^{12}$ | No problem |
| Ex. 2 | −32 | 1.52 ○ | $10^{11}$ | No problem | −30 | 1.50 ○ | $10^{12}$ | No problem |
| Ex. 3 | −25 | 1.48 ○ | $10^{10}$ | No problem | −20 | 1.42 ○ | $10^{9}$ | No problem |
| Ex. 4 | −20 | 1.46 ○ | $10^{10}$ | No problem | −15 | 1.35 Δ | $10^{8}$ | No problem |
| Ex. 5 | −28 | 1.50 ○ | $10^{11}$ | No problem | −27 | 1.48 ○ | $10^{10}$ | No problem |
| Ex. 6 | −26 | 1.52 ○ | $10^{9}$ | No problem | −25 | 1.46 ○ | $10^{9}$ | No problem |
| Ex. 7 | −29 | 1.50 ○ | $10^{9}$ | No problem | −16 | 1.38 Δ | $10^{12}$ | No problem |
| Ex. 8 | −21 | 1.55 ○ | $10^{8}$ | No problem | −18 | 1.52 ○ | $10^{7}$ | No problem |
| Ex. 9 | −23 | 1.52 ○ | $10^{9}$ | No problem | −20 | 1.50 ○ | $10^{8}$ | No problem |
| Comp. Ex. 1 | −20 | 1.45 ○ | $10^{10}$ | No problem | −8 | 1.10 X | $10^{6}$ | #3 |
| Comp. Ex. 2 | −35 | 1.31 Δ | $10^{14}$ | #2 | −33 | 1.32 Δ | $10^{13}$ | #4 |
| Comp. Ex. 3 | −28 | 1.48 ○ | $10^{10}$ | No problem | −15 | 1.29 X | $10^{7}$ | #5 |

#1 Amorphous $TiO_2$
#2 Dropout at boundary between half tone and character
#3 Deterioration in graininess and slight fogging on background
#4 Dropout at boundary between half tone and character and deterioration in graininess
#5 Deterioration in image quality caused by photoreceptor damage and low-density image due to low charge property As is clear from the results shown in Table 1, the examples according to the present invention are superior in various characteristics. Also, from the comparison between a group consisting of Examples 1, 2, 5, 6, 8, and 9 and a group of consisting of Examples 3, 4, and 7, examples having a value of X/Y ranging from 0.01 to 100 exhibit lower difference in the charge amount and in the SAD between the initial stage and after taking 200,000 copies in the evaluation using actual machine.

Example 10

| Preparation of C (cyan) toner particles | Part (s) |
|---|---|
| Binder resin [Bisphenol-type polyester resin, Mw: $1.5 \times 10^4$, Mn: $3.5 \times 10^3$, Tg: 61° C.] | 100 |

-continued

| Preparation of C (cyan) toner particles | Part (s) |
|---|---|
| Phthalocyanine pigment [C. I. Pigment Blue 15:3] | 5 |
| Charge control agent [BONTRON E84] | 2 |

The above components were made molten and kneaded using a Banbury mixer. The resultant composition was cooled, granulated, pulverized using a jet mill, and further classified using a pneumatic classifier to obtain toner particles with an average particle diameter of 7 μm. 100 parts of the toner particles and 1.0 part of External Additive (g) were mixed in a Henschel mixer to prepare a cyan toner composition.

| Preparation of M (magenta) toner particles | Part (s) |
|---|---|
| Binder resin [Bisphenol-type polyester resin, Mw: $1.5 \times 10^4$, Mn: $3.5 \times 10^3$, Tg: 61° C.) | 100 |
| C. I. Pigment Red 122 | 5 |
| Charge control agent [BONTRON E84] | 2 |

The above components were made molten and kneaded using a Banbury mixer. The resultant composition was cooled, granulated, pulverized using a jet mill, and further classified using a pneumatic classifier to obtain toner particles with an average particle diameter of 7 μm. 100 parts of the toner particles and 1.0 part of External Additive (g) were mixed in a Henschel mixer to prepare a magenta toner composition.

| Preparation of Y (yellow) toner particles | Part (s) |
|---|---|
| Binder resin [Bisphenol-type polyester resin, Mw: $1.5 \times 10^4$, Mn: $3.5 \times 10^3$, Tg: 61° C.] | 100 |
| C. I. Pigment Yellow 17 | 5 |
| Charge control agent [BONTRON E84] | 2 |

The above components were made molten and kneaded using a Banbury mixer. The resultant composition was cooled, granulated, pulverized using a jet mill, and further classified using a pneumatic classifier to obtain toner particles with an average particle diameter of 7 μm. 100 parts of the toner particles and 1.0 part of External Additive (g) were mixed in a Henschel mixer to prepare a yellow toner composition.

Preparation of Carrier D 100 parts of a ferrite core with an average particle diameter 50 μm was coated with 0.8 parts of a silicone resin (viscosity: 10 mpa's (25° C.)) using a kneader to prepare Carrier D.

Preparation of Developer 7 parts of each toner composition (C, M, Y toner composition) and 93 parts of Carrier D were mixed in a V-type blender to obtain a cyan developer, magenta developer, and yellow developer.

Example 11

A developer was prepared in the same manner as in Example 10 except that External Additive (h) was used instead of External Additive (g).

Example 12

A developer was prepared in the same manner as in Example 10 except that External Additive (i) was used instead of External Additive (g).

Example 13

A developer was prepared in the same manner as in Example 10 except that External Additive (j) was used instead of External Additive (g).

Example 14

A developer was prepared in the same manner as in Example 10 except that External Additive (k) was used instead of External Additive (g).

Example 15

A developer was prepared in the same manner as in Example 10 except that External Additive (m) was used instead of External Additive (g).

Example 16

A developer was prepared in the same manner as in Example 10 except that the amount of External Additive (g) was changed from 1.0 part to 0.05 parts.

Example 17

A developer was prepared in the same manner as in Example 10 except that the amount of External Additive (g) was altered from 1.0 part to 7 parts.

Comparative Example 4

A developer was prepared in the same manner as in Example 10 except that External Additive (n) was used instead of External Additive (g).

Comparative Example 5

A developer was prepared in the same manner as in Example 10 except that External Additive (o) was used instead of External Additive (g).

Comparative Example 6

A developer was prepared in the same manner as in Example 10 except that External Additive (p) was used instead of External Additive (g).

Comparative Example 7

A developer was prepared in the same manner as in Example 10 except that External Additive (q) was used instead of External Additive (g).

Comparative Example 8

A developer was prepared in the same manner as in Example 10 except that an R972 (trade name: hydrophobic silica; manufactured by Aerosil Co., Ltd.) Was used instead of External Additive (g).

Comparative Example 9

A developer was prepared in the same manner as in Example 15 except that hydrophobic amorphous titanium oxide was used instead of External Additive (g).

These developers were used to carry out a copying test by taking 50,000 copies using a copying machine (Able 1301a remodeled, manufactured by Fuji Xerox Co., Ltd.) Under conditions of high temperature and high humidity (30° C., 90% RH) and under conditions of low temperature and low humidity (5° C., 10% RH). The results are shown in Table 2.

TABLE 2

| | Sample of external additive | BET Specific surface area of titanium oxide$^{-1}$ ($m^2/g$) | Amount of external additive (parts) | Specific gravity | Surface treating agent for titanium oxide | Initial amount of charge*2 ($\mu c/g$) HT/HH*a | LT/LH*b |
|---|---|---|---|---|---|---|---|
| Ex. 10 | g | 100 | 1.0 | 3.5 | Isobutyltrimethoxysilane | −15 | −18 |
| Ex. 11 | h | 150 | 1.0 | 3.2 | Isobutyltrimethoxysilane | −18 | −22 |
| Ex. 12 | i | 200 | 1.0 | 3.2 | Isobutyltrimethoxysilane | −24 | −28 |
| Ex. 13 | j | 250 | 1.0 | 3.1 | Methyltrimethoxysilane | −22 | −28 |
| Ex. 14 | k | 40 | 1.0 | 2.8 | Methyltrimethoxysilane | −13 | −15 |
| Ex. 15 | m | 100 | 1.0 | 3.0 | Methyltrimethoxysilane | −17 | −20 |
| Ex. 16 | g | 100 | 0.05 | 3.5 | Isobutyltrimethoxysilane | −10 | −14 |
| Ex. 17 | g | 100 | 7.0 | 3.5 | Isobutyltrimethoxysilane | −27 | −39 |
| Comp. Ex. 4 | n | 10 | 1.0 | 3.6 | Methyltrimethoxysilane | −10 | −15 |
| Comp. Ex. 5 | o | 100 | 1.0 | 4.2 | Isobutyltrimethoxysilane | −20 | −25 |
| Comp. Ex. 6 | p | 120 | 1.0 | 3.9 | Methyltrimethoxysilane | −22 | −27 |
| Comp. Ex. 7 | q | 270 | 1.0 | 3.6 | Methyltrimethoxysilane | −26 | −33 |
| Comp. Ex. 8 | R972 | — | 1.0 | — | — | −22 | −36 |
| Comp. Ex. 9 | a-$TiO_2$ | — | 1.0 | — | — | −21 | −27 |

| | Amount of charge after 50,000 copies ($\mu c/g$) HT/HH*a | LT/LH*b | Total charging evaluation*3: Difference caused by condition | Maintainability | Fogging on background*4 | Dirtying of machine*5 | Image quality defect*6 | Transparency*7 | Coloring capability*8 | Color mixing inside developing unit*9 |
|---|---|---|---|---|---|---|---|---|---|---|
| Ex. 10 | −12 | −14 | ○ | ○ | ○ | ○ | No. problem | ○ | ○ | ○ |
| Ex. 11 | −15 | −18 | ○ | ○ | ○ | ○ | No problem | ○ | ○ | ○ |
| Ex. 12 | −15 | −20 | ○ | Δ | ○ | ○ | #1 | ○ | ○ | ○ |
| Ex. 13 | −14 | −18 | ○ | Δ | ○ | ○ | #2 | ○ | ○ | ○ |
| Ex. 14 | −8 | −12 | ○ | ○ | ○ | ○ | No problem | ○ | ○ | ○ |
| Ex. 15 | −13 | −15 | ○ | ○ | ○ | ○ | No problem | ○ | ○ | ○ |
| Ex. 16 | −8 | −11 | Δ | Δ | ○ | Δ | #3 | ○ | ○ | ○ |
| Ex. 17 | −22 | −30 | Δ | Δ | ○ | Δ | #4 | Δ | Δ | Δ |
| Comp. Ex. 4 | −4 | −10 | Δ | X | X | X | #3 | X | X | ○ |
| Comp. Ex. 5 | −6 | −14 | ○ | X | X | X | #6 | X | Δ | Δ |
| Comp. Ex. 6 | −10 | −20 | ○ | Δ | X | X | #4 | X | Δ | Δ |
| Comp. Ex. 7 | −12 | −18 | ○ | X | X | X | #5 | ○ | ○ | X |
| Comp. Ex. 8 | −11 | −18 | Δ | X | X | X | #6 | ○ | ○ | Δ |
| Comp. Ex. 9 | −6 | −10 | Δ | X | X | X | #6 | Δ | Δ | Δ |

HT/HH*aHigh temperature and high humidity

LT/LH*bLow temperature and low humidity

BET surface area of treated titanium*1: Measured using combined nitrogen and helium gas and using a Beta-Sorb automatic surface area measuring meter, MODEL 4200 (manufactured by Nikkiso Co., Ltd.).

Initial amount of charge*2: Measured at 25° C. under 55% RH using TB 200 (manufactured by Toshiba Corporation), allowing to stand for 24 hours in each condition after preparing a developer. The charge amount after taking 50,000 copies was measured in the same manner as above.

Total charging evaluation*3:

Difference caused by condition = (Initial amount of charge at high temperature, high humidity ÷ that at low temperature, low humidity + amount of charge after taking 50,000 copies at high temperature, high humidity ÷ that at low temperature, low humidity) X (½), which was totally evaluated according to the following standard: Standard for determining difference caused by condition: ○ ≧ 0.8, Δ ≧ 0.6, X < 0.6.

Maintainability = (Initial amount of charge under high-temperature and high-humidity conditions after taking 50,000 copies ÷ that in initial stage ÷ amount of charge under low-temperature and low-humidity conditions after taking 50,000 copies ÷ that in initial stage) X (½), which was totally evaluated according to the following standard: Standard for determining maintainability: ○ ≧ 0.8, 0.8 > Δ ≧ 0.6, X < 0.6.

Fogging on background*4: Visual inspection (○ Good, Δ Acceptable, X Not acceptable)

Dirtying of machine*5: Visual inspection (○ Good, Δ Acceptable, X Not acceptable)

Image quality defect*6:

#1: Inferior in maintainability to Example 10 but no problem though a little dirt appeared especially under high-temperature and high-humidity conditions as copies increased.

TABLE 2-continued

#2: Inferior in resistance to dependence of the charge property on the environmental condition (Difference caused by condition) and in maintainability to Example 1 but no problem in image quality up to 50,000 copies though slight fogging on the background.
#3: Clogging and dripping caused by a toner dispense inferior slightly occurred and, also, dirtying of a machine caused by an inferior admix.
#4: Superior in flow, and dirtying of machine caused by an inferior admix.
#5: Low density caused by increase in difference caused by condition over time.
#6: Low density caused by increase in difference caused by condition and by decrease in maintainability over time.
Transparency*7: Multicolor image after fixing color toner on OHP transparency visually observed (○ Good, Δ Acceptable, X Not acceptable).
Coloring capability*8: Visual inspection (○ Good, Δ Acceptable, X Not acceptable).
Color mixing inside developing unit*9: Visual inspection (○ Good, Δ Acceptable, X Not acceptable).

As is clear from the results shown in Table 2, the developers of the Examples are superior in various characteristics.

What is claimed is:

1. A developer comprising a carrier and a toner composition, wherein the carrier includes on a core a resin coating layer in which an electroconductive material is dispersed in a matrix resin and the toner composition includes toner particles containing a binder resin and a colorant, and, as an external additive, a titanium compound produced by the reaction of a $TiO(OH)_2$ with a silane compound.

2. A developer according to claim 1, wherein the specific gravity of said titanium compound is in a range from 2.8 to 3.6.

3. A developer according to claim 1, wherein said titanium compound is produced using a wet-sedimentation process.

4. A developer according to claim 1, wherein the average particle diameter of primary particles of said titanium compound is in a range from 5 to 50 nm.

5. A developer according to claim 1, wherein the ratio of the volumetric specific resistance of the carrier to that of titanium compound is in a range from 0.01 to 100.

6. A developer according to claim 1, wherein the average particle diameter of said core of said carrier is in a range from 30 to 100 $\mu$m.

7. A developer according to claim 1, wherein the average particle diameter of said toner particles is in a range from 3 to 10 $\mu$m.

8. A developer according to claim 1, wherein the volumetric specific resistance of said carrier is in a range from $10^6$ to $10^{12}$ Ωcm.

9. An image forming method comprising a step of forming electrostatic latent images on a latent image forming substrate and a step of developing said electrostatic latent images by a developer on a developer carrying substrate, wherein said developer comprises a carrier including on a core a resin coating layer in which an electroconductive material is dispersed in a matrix resin and the toner composition including toner particles containing a binder resin and a colorant, and, as an external additive, a titanium compound produced by a reaction of a $TiO(OH)_2$ with a silane compound.

10. A multicolor image forming method comprising a step of forming electrostatic latent images on a latent image forming substrate and a step of developing said electrostatic latent images by a plurality of developers to form multicolor toner images, wherein said developer includes toner particles containing at least a binder resin and a colorant, and, as an external additive, a titanium compound which is produced by a reaction of a $TiO(OH)_2$ with a silane compound and which has a BET specific surface area of from 40 to 250 $m^2/g$.

11. A multicolor image forming method according to claim 10, wherein the specific gravity of said titanium compound is in a range from 2.8 to 3.5.

12. A multicolor image forming method according to claim 10, wherein said plurality of developers consists of a cyan developer, a magenta developer, and a yellow developer.

13. A multicolor image forming method according to claim 10, wherein said plurality of developers consists of a cyan developer, a magenta developer, a yellow developer, and a black developer.

14. A multicolor image forming method according to claim 10, wherein each of said plurality of developers contains said titanium compound in an amount of from 0.1 to 5 parts by weight to 100 parts by weight of said toner particles.

15. A multicolor image forming method according to claim 10, wherein said developer further includes a carrier.

* * * * *

UNITED STATES PATENT AND TRADEMARK OFFICE

CERTIFICATE OF CORRECTION

PATENT NO. : 5,863,684

DATED : January 26, 1999

INVENTOR(S) : Chiaki SUZUKI et al.

It is certified that error appears in the above-indentified patent and that said Letters Patent is hereby corrected as shown below:

On the cover page, item [56], line 4 change "5,665,512" to --5,665,511--.

Signed and Sealed this

Sixth Day of July, 1999

*Attest:*

Q. TODD DICKINSON

*Attesting Officer*

*Acting Commissioner of Patents and Trademarks*